United States Patent [19]

Fleischhauer

[11] Patent Number: 4,653,137

[45] Date of Patent: Mar. 31, 1987

[54] VACUUM CLEANER ATTACHMENTS

[76] Inventor: Eugene Fleischhauer, 1413 Wesanne La., Midlothian, Va. 23113

[21] Appl. No.: 832,173

[22] Filed: Feb. 20, 1986

[51] Int. Cl.[4] ..... A47L 9/06

[52] U.S. Cl. ..... 15/374; 15/416; 285/7

[58] Field of Search ..... 15/374, 416; 285/7

[56] References Cited

U.S. PATENT DOCUMENTS

| | | | |
|---|---|---|---|
| 1,699,598 | 1/1929 | Lee . | |
| 1,708,194 | 4/1929 | Smidley . | |
| 1,725,762 | 8/1929 | Lee . | |
| 1,785,675 | 12/1930 | Cundiff . | |
| 1,826,798 | 10/1931 | Lee . | |
| 1,867,284 | 7/1932 | Smidley . | |
| 2,394,798 | 2/1946 | McNeal | 15/374 X |
| 2,396,862 | 3/1946 | Linderoth | 15/374 X |
| 2,519,741 | 8/1950 | Caughey . | |
| 2,554,238 | 5/1951 | Burri . | |
| 2,610,351 | 9/1952 | Lilly . | |
| 2,643,413 | 6/1953 | Buccasio . | |
| 2,679,068 | 5/1954 | Wied . | |
| 2,869,170 | 1/1959 | Wessel . | |
| 3,306,634 | 2/1967 | Groves et al. | 285/7 |
| 4,537,424 | 8/1985 | Maier et al. | 285/7 |

OTHER PUBLICATIONS

Advertisement, Hoover Quick-Broom, Copyright 1983.

Advertisement, Sears Power-Mate Cannister Vacuum, The Washington Post, Feb. 22, 1985.

*Primary Examiner*—Chris K. Moore

*Attorney, Agent, or Firm*—Hughes & Cassidy

[57] ABSTRACT

Vacuum cleaner attachments which have a V-shaped cleaning head and are particularly suited for cleaning in corners and crevices and along the edges of surfaces. Vertically biased and rotatable brushes and other disturbers can be provided to promote the dislodgement of foreign substances from the surface being cleaned; and the attachment can be constructed to operate in a first mode in which suction is concentrated in the nose of the attachment, causing it to emulate a conventional crevice tool. In a second mode of operation, the suction is distributed along the legs or wings of the attachment so that it functions in a manner akin to that of a dusting brush or floor cleaning attachment. An optional control and a detent arrangement allow more sophisticated versions of the attachment to be operated in a selected one of the foregoing modes or in a third mode in which the attachment alternates between the two first-mentioned modes of operation as it is pushed away from and pulled toward the operator. A preferred universal-type connection between the cleaning head and a vacuum fitting attached thereto facilitate the manipulation of the attachment and allow pressure to be brought to bear on the nose of the cleaning head, thereby promoting the dislodgement of foreign substances from the surface being cleaned.

21 Claims, 12 Drawing Figures

2
28
94
96
22
136
120
48
98
104
26
36
106
122
44
130
6
7
34
82
3
90
56
70
78
80
60
59
132
134
53
54
64
92
68
66
62
55
88
30
42
128
38
20
24
46
32
5

84
56
76
70
80
78
86
77
62
55
74
60
68
58

10
28
142
152
146
153
210
204
200
26
36
196
48
202
198
44
206
11
34
40
52
208
174
172
194
180
155
144
158
162
156
160
143
30
38
170
24
32
46
42

VACUUM CLEANER ATTACHMENTS

TECHNICAL FIELD OF THE INVENTION

The present invention relates to vacuum cleaner attachments which are designed to easily and efficiently reach such hard-to-clean areas as: (1) corners and (2) the edges between, for example, a floor and a wall, two walls, or a wall and a ceiling. The principles of the present invention may also be employed in attachments designed to clean furniture and other artifacts and constructed to reach into crevices, corners, etc. of such artifacts.

BACKGROUND OF THE INVENTION

As will be appreciated by those to whom this specification is particularly addressed, corners, edges, etc. are particularly difficult to reach with conventional upright vacuum cleaners and with dusting and floor brushes and other conventional vacuum cleaner attachments. And special purpose attachments such as crevice tools are inconvenient to use and time consuming in applications such as the cleaning of the edges of a large room.

SUMMARY OF THE INVENTION

I have now invented novel vacuum cleaner attachments which allow corners, edges, and other hard-to-reach areas to be cleaned rapidly and with ease. These novel implements can be attached to the wands or hoses of cannister type vacuum cleaners and to the same components of upright vacuum cleaners. They can also be attached directly to, or integrated into, stick-type vacuum cleaners such as the Hoover Quick-Broom.

In general, the novel vacuum cleaner attachments that I have invented have a V-shaped configuration when viewed from above. This configuration is attributable to two legs or wings which define downwardly opening, U-sectioned vacuum or suction chambers and meet at an angle (typically 90°) to form a sharp nose that can reach into corners and closely follow the edges of the surface being cleaned. Downwardly biased and freewheeling brushes can be mounted in the vacuum chambers to dislodge dirt and other foreign substances from the surface being cleaned, and wheels and other ground-engaging components can be provided to space the vacuum chamber defining legs in the proper relation to the surface being cleaned and/or to facilitate the movement of the attachment across that surface.

The vacuum or suction chambers in the V-shaped cleaning head are connected to a vacuum source—typically a wand—via a tubular vacuum fitting. Preferably, a universal connection is provided between the fitting and the cleaning head to facilitate the manipulation of the attachment. And the tubular fitting may be configured so that pressure may be brought to bear on the nose of the cleaning attachment, thereby promoting the removal of foreign substances from the surface being cleaned.

An optional feature of the novel vacuum cleaner attachments disclosed herein is an arrangement which involves a sliding vacuum fitting and allows a concentrated suction to be developed in a separate chamber at the nose of the vacuum cleaner attachment. This is particularly useful in removing foreign substances from corners and edges of the surface being cleaned. This fitting is preferably biased away from the forward end of the attachment so that the suction will be distributed over the vacuum chambers in the wings of the cleaning head when the attachment is pulled toward the operator. As a consequence, the attachment functions during this stroke in a manner akin to that of a conventional dust brush or floor cleaning implement, for example. Thus, a vacuum cleaner attachment with this novel dual mode of operation combines the capabilities of an implement such as one of those just described and a crevice tool into a single attachment.

It may on different occasions be advantageous to regulate the operation of the attachment so that the suction is concentrated in the nose of the cleaning head or distributed over the wings of the head irregardless of the direction of movement of the attachment or to adjust the attachment so that the suction will be concentrated in the nose of the attachment during the forward stroke but also spread over the wings of the cleaning head during the rearward stroke. I have also invented and disclosed in detail herein two novel attachments in which provision is made for providing that mode of operation on an "as wanted" basis. One of these attachments includes a novel control arrangement with an operator which can be manipulated to select one of these three modes of operation. The other of these attachments has a novel detent system which can be employed with equivalent results.

Several direction related terms such as bottom, lower, etc. have been employed above and will be used hereinafter. These terms are employed on the premise that the attachment being described is resting on a horizontal surface. They are furthermore employed solely for the sake of convenience and clarity and are not intended to impose any limitation on the scope of my invention as defined in the appended claims.

THE PRIOR ART

Vacuum cleaner attachments and vacuum cleaners with cleaning heads superficially resembling those I have invented and/or said to be useful for edge cleaning are described and illustrated in an advertisement for a Hoover Quik-Broom copyrighted in 1983; in an advertisement for a Sears Power-Mate vacuum cannister appearing in the Feb. 22, 1985, edition of the Washington Post; and in the following U.S. patents:

| U.S. Pat. No. | Patentee | Issue Date |
|---|---|---|
| 1,699,598 | Lee | January 22, 1929 |
| 1,708,194 | Smidley | April 9, 1929 |
| 1,725,762 | Lee | August 27, 1929 |
| 1,785,675 | Cundiff | December 16, 1930 |
| 1,826,798 | Lee | October 13, 1931 |
| 1,867,284 | Smidley | July 12, 1932 |
| 2,519,741 | Caughey | August 22, 1950 |
| 2,554,238 | Burri | May 22, 1951 |
| 2,610,351 | Lilly | September 16, 1952 |
| 2,643,413 | Buccasio | June 30, 1953 |
| 2,679,068 | Wied | May 25, 1954 |
| 2,869,170 | Wessel | January 20, 1959 |
| 3,585,670 | MacKinnon | June 22, 1971 |

As suggested above, however, the resemblances between the devices disclosed in the just-cited references and the novel vacuum cleaner attachments I have invented are no more than superficial. While the Lee '598, Smidley '194, Lee '762, Cundiff '675Lee '798, Smidley '284, and Caughey patents disclose vacuum cleaning devices with cleaning heads which resemble applicant's novel vacuum cleaning attachments to the extent that they have a V- or V-like configuration, this is as far as the resemblance goes. The cleaning heads of the implements disclosed in the foregoing patents are integral vacuum cleaner components and not attachments. Consequently, they are not as easy to manipulate as my novel attachments; and, unlike the latter, they cannot be used to clean walls, ceilings, furniture, etc. Furthermore, no provision is made for concentrating the suction in the nose of the cleaning head to promote the removal of foreign substances from the surface being cleaned; and features such as the universal joint which facilitates the manipulation of applicant's novel attachments are entirely lacking as are applicant's free wheeling and downwardly biased brushes.

The remainder of the above-cited references do disclose vacuum cleaner attachments with the exception of the Hoover Quick-Broom advertisement. That advertisement discloses a vacuum cleaner which can be handled much like the wand of a cannister or hose-equipped upright vacuum cleaner. However, the implements disclosed in the two advertisements lack the V-shaped configuration found necessary by applicant for efficient edge and corner cleaning; and all of the implements disclosed in the references in question lack the selectively employable, concentrated suction feature of applicant's novel attachments, the downwardly biased and freewheeling brushes, and the universal connections which make it possible to so easily and deftly manipulate applicant's novel vacuum cleaner attachments.

OBJECTS OF THE INVENTION

From the foregoing it will be apparent to the reader that one important and primary object of my invention resides in the provision of novel, improved vacuum cleaner attachments.

Other also important but more specific objects of my invention reside in the provision of vacuum cleaner attachments as aforesaid:

which are capable of cleaning effectively in corners and along edges such as those between a floor or ceiling and a wall and those between two walls;

which can be used both with cannister type vacuum cleaners and with upright cleaners equipped with a wand;

which are so constructed that: (1) a powerful vacuum can be applied at the nose of the attachment to promote the removal of dirt and other foreign material, and (2) a lower vacuum can instead be applied over the width of the attachment so that it will emulate a conventional rug or floor cleaning or similar vacuum cleaner attachment;

which, in conjunction with the foregoing object, will automatically shift between the aforesaid modes of operation as said attachment is respectively pushed away from and pulled toward the user or operator of the vacuum cleaner;

which, in conjunction with the last object but one, have a control that can be operated, or a dent arrangement that can be employed, to lock the attachment in a selected one of the modes of operation identified in that object;

which provide for universal movement of the attachment relative to the wand or other fixture to which it is attached, thereby facilitating the manipulation of the attachment by the user of the vacuum cleaner;

which incorporate brushes that are rotatable in a manner that effectively dislodges foreign substances from the surface being cleaned;

which combine the functions of a conventional crevice tool and an upright vacuum cleaner or a general cleaning tool such as a carpet or floor cleaning vacuum cleaner attachment;

which are particularly useful in cleaning around area rugs;

which are versatile in that they can be employed to clean such diverse artifacts as bare floors, rugs and carpets, walls, ceilings, cornices and other moldings, and furniture;

which can be coupled to the vacuum inlet of a stick-type vacuum cleaner as well as to the wand of a cannister or upright type vacuum cleaner.

Other important objects and feature and additional advantages of my invention will be apparent to the reader from the foregoing and the appended claims and as the ensuing detailed description and discussion of the invention proceeds in conjunction with the accompanying drawing.

DETAILED DESCRIPTION OF THE INVENTION

Figure 1:
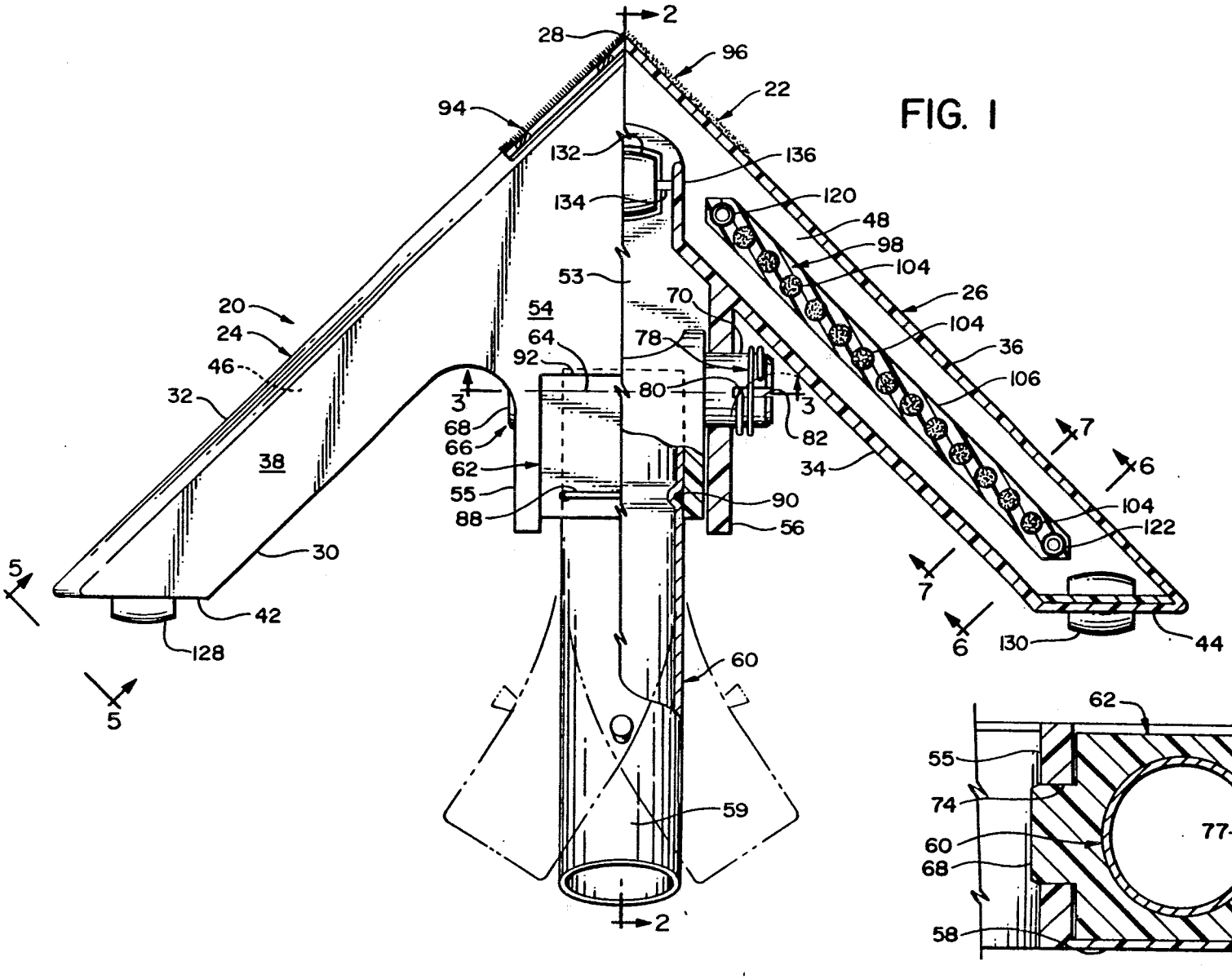
FIG. 1 is a plan view of a vacuum cleaner attachment embodying, and constructed in accord with, the principles of the present invention.

Referring now to the drawing, FIGS. 1–7 show, in detail, the construction of a vacuum cleaner attachment 20 embodying, and constructed in accord with, the principles of the present invention.

Essential to attachment 20 is a V-shaped housing 22 with two integral wings 24 and 26 which meet at the forward end of the attachment at an angle of (typically) 90°. This forms a sharp nose 28 which can reach into corners and other spots that are inaccessible to a typical conventional vacuum cleaner or vacuum cleaner attachment.

The two wings 24 and 26 of the housing have parallel, spaced apart, vertically extending inner and outer side walls 30, 32 and 34, 36. Because the outer side walls 32 and 36 are straight, attachment 20 can also closely follow the edge of a room being cleaned, for example.

In addition to the just-identified inner and outer walls 30, 32 and 34, 36, the wings 24 and 26 of housing 22 include flat, horizontal top walls 38 and 40 and rear walls 42 and 44 which cooperate with the inner and outer side walls to form vacuum chambers 46 and 48 having an inverted-U cross-sectional configuration. These vacuum chambers are open at the lower edges 50 and 52 of wings 24 and 26.

Communicating with vacuum chambers 46 and 48 in the two wings 24 and 26 of vacuum attachment 20 is a vacuum plenum 53. That plenum is defined by an integral section of housing 22 which has a top wall 54, side walls 55 and 56, and a bottom wall 58. This part of the housing is centered on the fore-to-aft centerline 59 of attachment 20 and extends toward the rear of the attachment from the intersection at the nose of the attachment between the two inner walls 30 and 34 of the attachment's two wings 24 and 26.

The vacuum chambers 46 and 48 in the two wings 24 and 26 of attachment 20 are connected at their forward ends through plenum 53 to a vacuum source (not shown) by a tubular vacuum fitting 60. This fitting has a rear section 61 that is inclined upwardly to facilitate its attachment to the lower end of a conventional vacuum cleaner wand and to allow downward pressure to be exerted on attachment 20. Fitting 60 is housed for rotation about the longitudinal centerline 59 of attachment 20 in, and detachably fixed to, a vacuum fitting support 62. The latter is supported from the vacuum plenum defining side walls 55 and 56 of housing 22 for rotation about a transversely extending, horizontal pivot axis 64 by a pivot member 66. This results in a universal type connection between fitting 60 and housing 22. The connection facilitates the manipulation of the vacuum cleaner attachment 20.

In this embodiment of my invention, and those discussed hereinafter, it is preferred that the transverse axis 64 about which the vacuum fitting is vertically pivoted be located about one-third of the fore-to-aft distance between the nose and rear end of the attachment. This also allows the operator to exert downward pressure on the attachment to thereby promote its cleaning efficiency.

Figure 3:
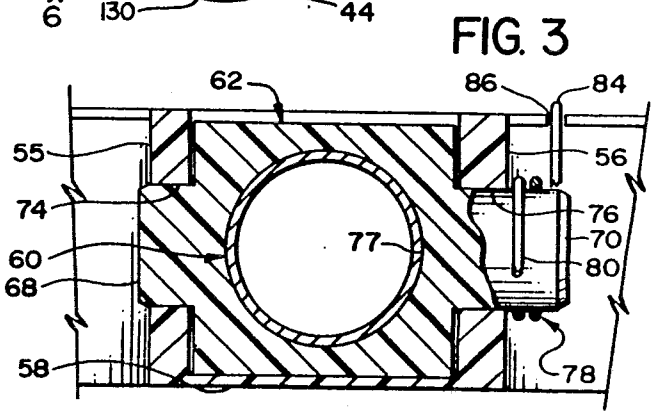
FIG. 3 is a section through the vacuum cleaner attachment of FIG. 1, taken substantially along line 3—3 of the latter figure.

As is perhaps best shown in FIG. 3, pivot member 66 is made up of two transversely extending, circularly sectioned, pivot lugs 68 and 70 which are integral components of vacuum fitting support 62 and are rotatable about transverse axis 64, which lies in the vertical midplane of housing 22. The two pivot lugs 68 and 70 extend through openings 74 and 76 in the vertical, plenum defining side walls 55 and 56 of vacuum cleaner attachment housing 22. This rotatably journals the lugs in those side walls.

The above-mentioned vacuum fitting support 62 has a generally rectangular section and a central, fore-and-aft extending passage 77. That passage provides fluid communication between vacuum fitting 60 and the plenum 53 which connects the latter to those vacuum chambers 46 and 48 in the two wings 24 and 26 of housing 22.

Housing 22 is biased downwardly relative to fitting 60 by a spring 78 coiled around pivot lug 70. One end 80 of this spring is fitted into a slot 82 through pivot lug 70. The other end 84 of spring 78 is fitted into a slot 86 through the vacuum plenum defining top wall 54 of vacuum attachment housing 22. This gives spring 78 a tendency to unwind which furnishes the bias just discussed and thereby tends to keep the lower edges 50 and 52 of the vacuum cleaner attachment wings 24 and 26 flat against the surface being cleaned.

Vacuum fitting 60 is detachably secured in support 62 by a conventional expandable retainer ring 88. The retainer ring is fastened to support 62 and fits into a circumferential recess 90 located in the forward end 92 of vacuum fitting 60.

Figures 2, 4, 5, 6, 7:
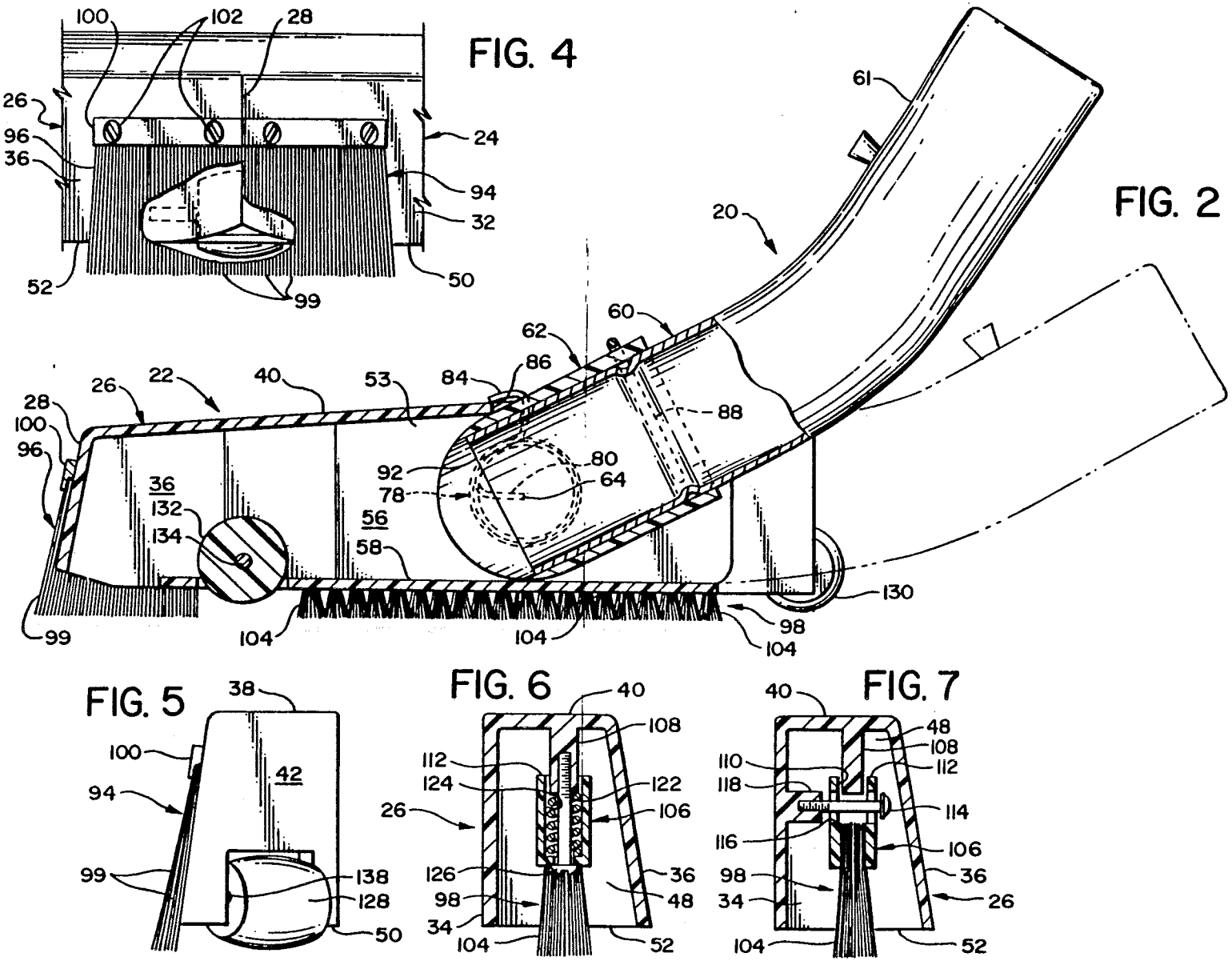
FIG. 2 is a longitudinal section through the vacuum cleaner attachment of FIG. 1, taken substantially along line 2—2 of that figure.
FIG. 4 is a partial front elevation of the vacuum cleaner attachment.
FIG. 5 is an elevation of the attachment, taken substantially along line 5—5 of FIG. 1.
FIGS. 6 and 7 are sections through the vacuum cleaner attachment, taken substantially along lines 6—6 and 7—7 of FIG. 1.

Limits on the vertical, pivotal movement of vacuum fitting 60 are shown in FIG. 2. Orientations to which it can be rotated about the fore-and-aft centerline 59 of vacuum cleaner attachment 20 are shown in solid and phantom lines in FIG. 1.

As suggested by the foregoing decription of attachment 20, the vacuum chambers 46 and 48 in its two wings 24 and 26 communicate with the surface on which the attachment is deployed, and vacuums are generated in these two chambers by way of vacuum plenum 53 and vacuum fitting 60. Consequently, foreign substances loose on, or dislodged from, that surface are propelled through those chambers, the vacuum plenum, vacuum fitting 60, and a wand, hose, or the like to a collection point, typically in a disposable or other vacuum cleaner bag.

To dislodge foreign substances from the surface being cleaned, vacuum cleaner attachment 20 is preferably equipped with vertically depending brushes 94 and 96, which protrude beyond the lower edge of attachment housing 22 at the nose 28 of the attachment, and with similarly oriented and protruding brushes in those vacuum chambers 46 and 48 located in the two wings 24 and 26 of the attachment. One of the latter brushes is shown in FIGS. 1, 2, 6, and 7 and identified by reference character 98.

The two brushes 94 and 96 at the nose end of the vacuum cleaner attachment each have bristles 99 fixed to a holder 100. The latter is secured to the outer, vertically depending wall 32 or 36 of the wing 24 or 26 with which it is associated as by conventional screws 102.

Each of the two vacuum chamber housed brushes includes bundles 104 of bristles spaced along, and fixed at their upper ends to, a holder 106. The holder is located midway between, and parallel to, the inner and outer walls 30 and 32 or 34 and 36 of the vacuum cleaner attachment wing 24 or 26 in which the brush is located. As best shown in FIG. 1, these brushes extend generally from end-to-end of the wing in which they are housed.

To accommodate attachment 20 to surfaces of different textures, the two brushes housed in the wings 24 and 26 of the vacuum cleaner attachment are mounted for vertical displacement in the wings of housing 22 and are biased toward the lower ends of those wings. The mounting and biasing arrangements are shown in FIGS. 7 and 6, respectively.

Turning first to the former, both brushes are mounted on guides depending from, and integral with, an attachment wing top wall 38 or 40. One of these guides is illustrated in FIG. 7 and identified by reference character 108.

The brush guides fit into vertical recesses opening onto the top wall of the holder component 106 of the involved brush. In FIG. 7, one such recess is identified by reference character 110; and the top wall of the brush holder is identified by reference character 112.

As shown in the same figure, the brushes such as that identified by reference character 98 are secured in place by screws 114. These screws extend through elongated, vertical displacement accommodating slots 116 in brush holder 106 and are threaded into an integral boss 118. That boss extends inwardly, and horizontally, from the inner vertical wall 30 or 34 of a vacuum cleaner attachment wing 24 or 26.

Turning now to FIG. 6, springs 120 and 122 at the forward and rear ends of the two vacuum chamber-housed brushes bias those brushes toward the surface being cleaned. These springs are housed in upwardly opening recesses in brush holder 106. One of these spring housing recesses is shown in FIG. 6 and identified by reference character 124.

A screw 126 extends upwardly through the brush holder 106 and is threaded into the guide or boss 108 integrally depending from the vacuum chamber defining top wall 38 or 40. That limits the downward travel of the spring 120 or 122, which is compressed between the lower end of boss 108 and the bottom end of the recess 124 in which it is housed.

Vacuum cleaner attachment 22 is made mobile by wheels 128 and 130 at the trailing or aft ends of vacuum chamber defining wings 24 and 26 and by a third wheel 132 at the nose 28 of attachment 20.

Wheel 132 is mounted on a transversely extending axle 134. The axle is rotatably supported in integral extensions at the forward ends of vacuum chamber defining inner walls 30 and 34. One of these extensions is shown in FIG. 1 and identified by reference character 136.

The two wheels 128 and 130 at the aft end of the attachment are supported by axles from the inner and outer, vacuum chamber defining side walls 30, 32 or 34, 36 of the attachment's two wings 24 and 26. One of these two axles is identified by reference character 138 in FIG. 5.

Figure 8:
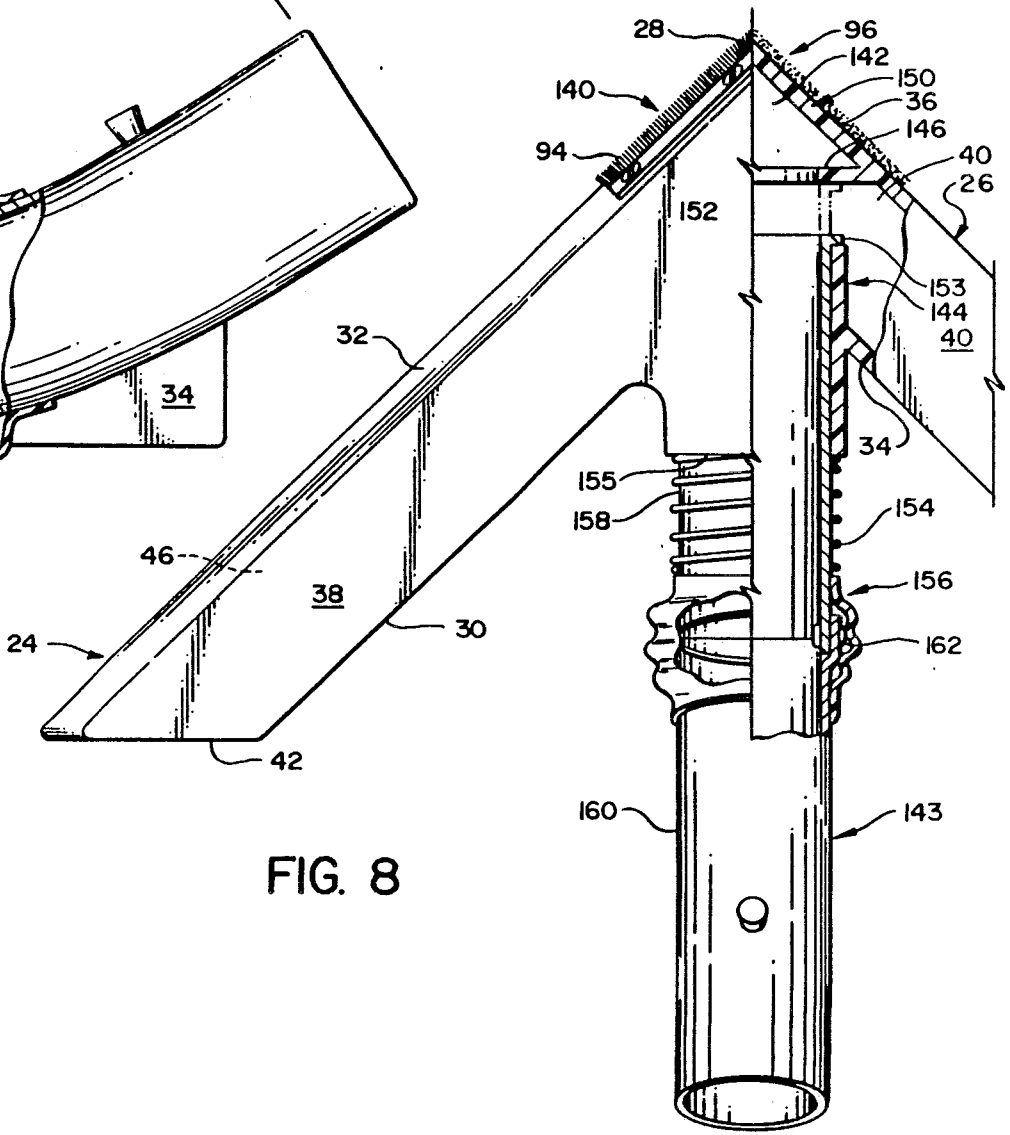
FIG. 8 is a plan view of a second form of vacuum cleaner attachment in accord with the principles of the present invention.

Referring still to the drawing, FIG. 8 depicts a vacuum cleaner attachment 140 similar to the attachment 20 just discussed but constructed so that the suction can be concentrated in the nose 28 of the attachment. This promotes cleaning in corners and other hard-to-reach spots. Alternatively, the vacuum can be distributed over the span of the attachment's two wings 24 and 26, causing the attachment to function in a manner akin to that of a conventional vacuum cleaner floor brush.

Physically, vacuum cleaner attachment 140 differs from the attachment 20 just discussed primarily in that: (1) a separate vacuum chamber 142 is formed in the nose 28 of attachment 140, and (2) tubular vacuum fitting 143 is slidably mounted in its support 144 so that it can be displaced relative to the housing 22 of the attachment. This is done to: (1) concentrate the vacuum in, and confine it to, vacuum chamber 142 in the nose 28 of the attachment when the attachment is pushed away from the operator so that the attachment will pick up debris that might otherwise be left on the surface being cleaned, and (2) apportion the vacuum among vacuum chamber 142 and the two vacuum chambers 46 and 48 in the wings 24 and 26 of attachment 140 when the attachment is pulled toward the operator so that the vacuum will be distributed over the span of the attachment. That gives the attachment the wanted, and above-mentioned, capabilities of a conventional floor brush.

Referring still to FIG. 8, a vertical, transversely extending, integral partition 146 is formed in the nose 28 of vacuum cleaner attachment housing 150 between the two outer walls 32 and 36 of that attachment's wings 24 and 26. Formed in this partition is a central opening 152 which is somewhat smaller in diameter than the tubular vacuum fitting 143.

Fitting 143 can be displaced forwardly to the position shown in phantom lines in FIG. 8. In that position, communication with the vacuum fitting 143 is limited to the vacuum chamber 142 in the nose 28 of vacuum attachment 140. This is occasioned when the attachment is pushed into a corner or the housing 22 of the attachment otherwise prevented from moving as rapidly as the wand, hose, etc., by which it is pushed.

In its rearward, or retracted, position relative to the housing as shown in full lines in FIG. 8, the interior of vacuum fitting 143 still communicates through central opening 152 with the vacuum chamber 142 in the nose of housing 22. However, in this instance, it also communicates with the two vacuum chambers 46 and 48 in the wings 24 and 26 of the attachment so that the vacuum is applied to those vacuum chambers as well as to the vacuum chamber 142 in nose 28 of the attachment. Thus, in this configuration, the attachment acts as a conventional floor brush.

Referring still to FIG. 8, the vacuum fitting support 144 of vacuum cleaner attachment 140 has a cylindrical configuration. It is centrally located, extends in a fore-and-aft direction, and is integral with and supported from the inner walls 30 and 34 of the two vacuum cleaner wings 24 and 26.

Fitting 143 is retained in support 144 by a flange 153 at its forward end, and the fitting is biased to the rearward position shown in full lines in FIG. 8 by a coil spring 154. That spring surrounds fitting 143; it is trapped between the rear end 155 of the support and the forward end of a flexible sleeve 156 surrounding the fitting.

To provide a universal connection between the housing 22 of the attachment and vacuum fitting 143, the latter is dimensioned for rotation about the longitudinal centerline of the attachment in its support 144; and it is formed of front and rear, straight and curved sections 158 and 160 coupled together for rotation about a transverse axis by pivot pins 162 (one of which is shown in FIG. 8).

The flexible sleeve 156 alluded to above spans the joint between the two vacuum fitting components 158 and 160 and keeps air from leaking into the vacuum fitting through this joint.

Figure 10:
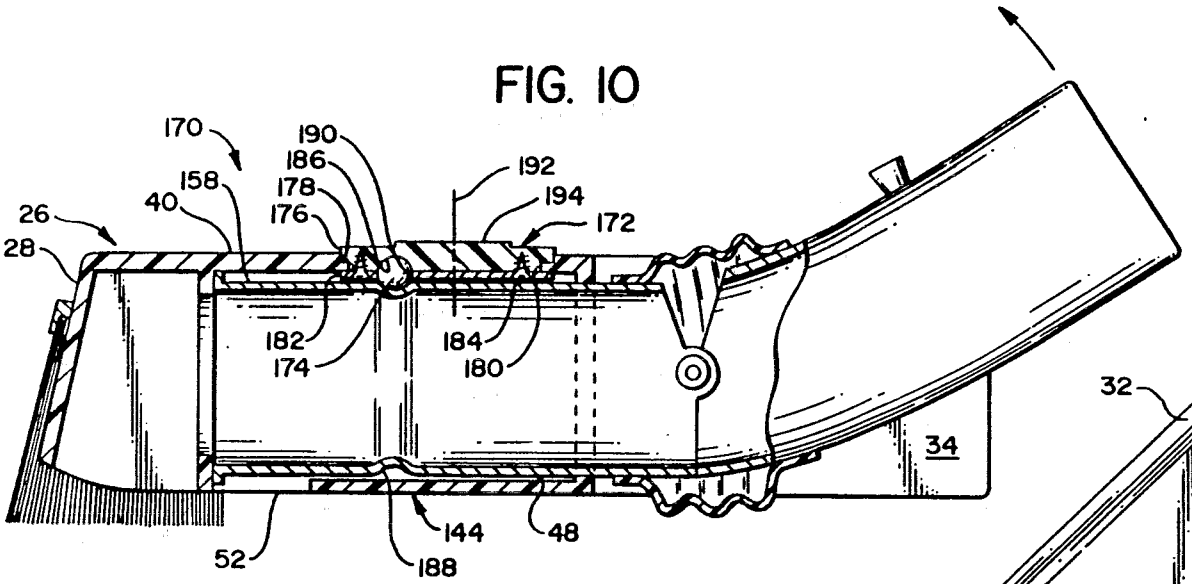
FIGS. 10 and 11 are sections through the vacuum cleaner of FIG. 9, taken substantially along lines 10—10 and 11—11 of FIG. 9, respectively.
Figures 9, 11:
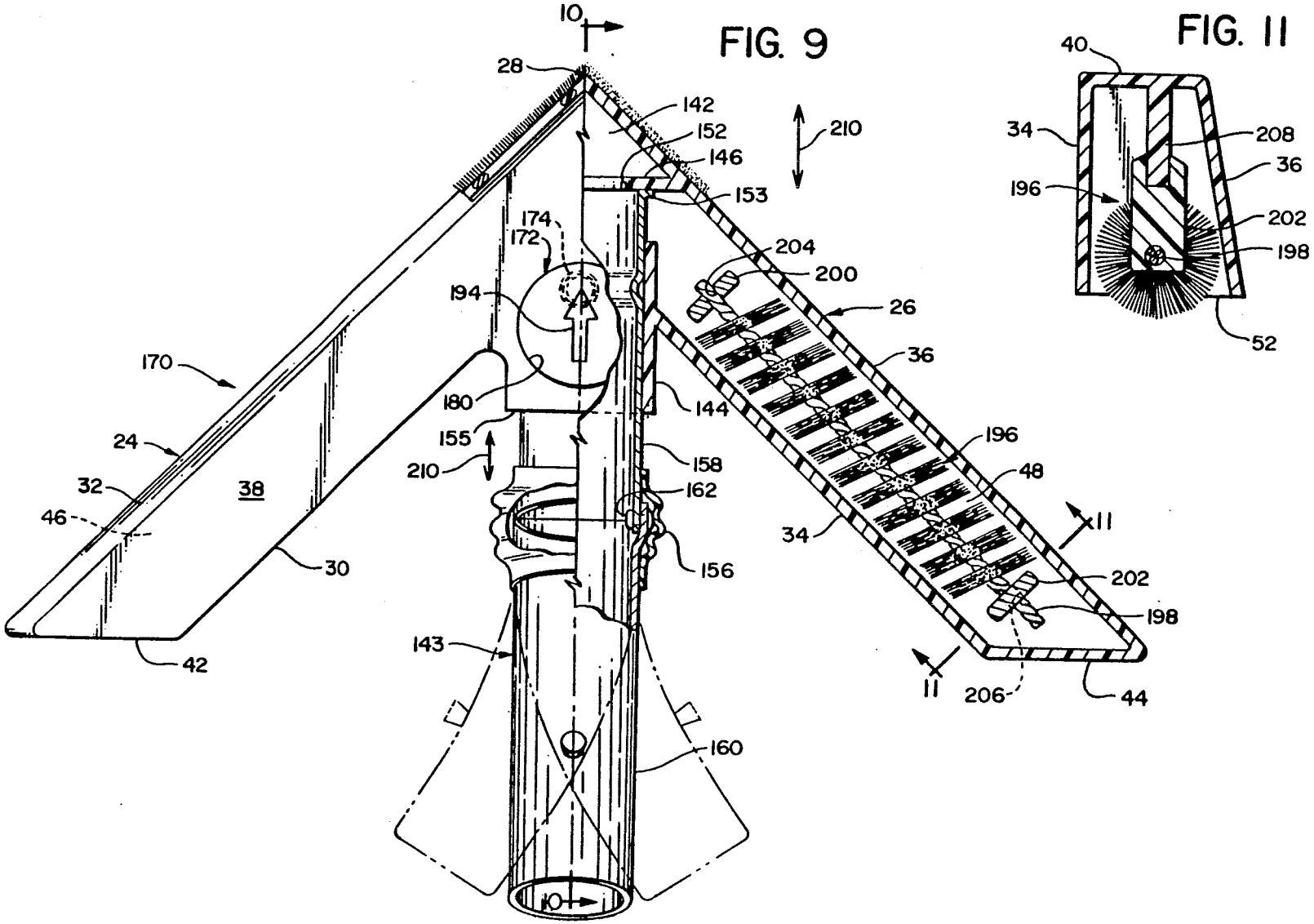
FIG. 9 is a plan view of a third embodiment of vacuum cleaner attachment embodying the principles of my invention.

Referring still to the drawing, FIGS. 9–11 depict a vacuum cleaner attachment 170 also embodying the principles of my present invention. This attachment differs from that shown in FIG. 8 and identified by reference character 140 primarily in that vacuum fitting 143 can be: (1) locked in the forward or extended position shown in FIG. 9 to confine the vacuum to the chamber 142 in the nose 28 of the attachment, (2) locked in a retracted position like that shown in FIG. 8 so that the vacuum can also be distributed over the two wings 24 and 26 of the attachment, or (3) left free to move between operator-determined positions which allow the vacuum to be concentrated in the nose of the attachment during a forward stroke or halting of the attachment and distributed over the wings of the attachment during a return stroke. Also, this attachment differs physically from those discussed earlier in that free-wheeling rotary brushes are employed in the two wings 24 and 26 of the attachment to dislodge foreign substances from the surface being cleaned.

The mechanism for locking the vacuum fitting 143 in the positions just discussed to respectively concentrate the vacuum in the nose of the attachment and to distribute that vacuum over the span of the attachment and for freeing that fitting to provide one or the other of those modes of operation depending upon the direction of movement of attachment 20 is best shown in FIGS. 9 and 10. That mechanism includes an operator-accessible dial 172 and a ball 174 for translating rotary movement of the dial into rectilinear, fore-and-aft movement of the vacuum fitting.

Dial 172 has a horizontal, annular ledge 176. This ledge is seated on an annular shoulder 178 around a recess 180 in the top of integral vacuum fitting support 144. A plate 182 fixed to the dial as by screws 184 traps the dial against, and above, ledge or shoulder 178.

Ball 174 is seated in a matching recess 186 opening onto the bottom of dial 172 and in a circumferential recess 188 which is located in the forward section 158 of vacuum fitting 143. There is an opening 190 through cover plate 182 which accommodates this relationship among the ball, support, and vacuum fitting and keeps the ball from dropping out of the dial.

As a consequence of its just-described connection through ball 174 to vacuum fitting 143, rotation of dial 172 about its vertical axis 192 is translated by ball 174 into the wanted fore-and-aft rectilinear movement of fitting 143.

As is best shown in FIG. 9, a raised, integral arrow 194 is preferably formed on the top side of dial 172. This arrow facilitates rotation of the dial by the operator and, also, identifies the position the vacuum fitting is in with respect to the housing 22 of attachment 170—locked forward, locked rearward, or freed for movement during the forward and return strokes of attachment 20. Detents (not shown) are typically provided to retain the dial in positions to which it is rotated to move the vacuum fitting to the first two of its foregoing positions.

Referring now in particular to FIGS. 9 and 11, one of the two rotary, foreign substance dislodging brushes of vacuum cleaner attachment 170 is identified by reference character 196. That brush, which spans the major part of wing 26 of the attachment, and protrudes below the lower edge of its housing, is mounted on an axle 198. The latter is rotatably supported in wing 26 midway between the vertically extending, inner and outer walls 34 and 36 of the latter for rotation about an axis parallelling those walls by front and rear supports 200 and 202. The latter have apertures 204 and 206 through which the axle extends; and they are supported from a depending boss 208 which extends along, and is integral with, the top wall 40 of wing 26.

As is best shown in FIG. 9, the brushes 196 are set at an angle with respect to the usual direction-of-movement of attachment 170 (indicated by arrow 210 in FIG. 9). This creates friction which causes the brushes to rotate as attachment 170 is displaced over the surface being cleaned and, also, produces a scrubbing action which is effective to dislodge stubborn debris from the surface being cleaned.

Like the brush shown in FIG. 1 and discussed above, those identified by reference character 196 can also be mounted for vertical spring-loaded displacement from the housing of the attachment in which they are incorporated to gain the advantages the latter mounting arrangement affords.

Figure 12:
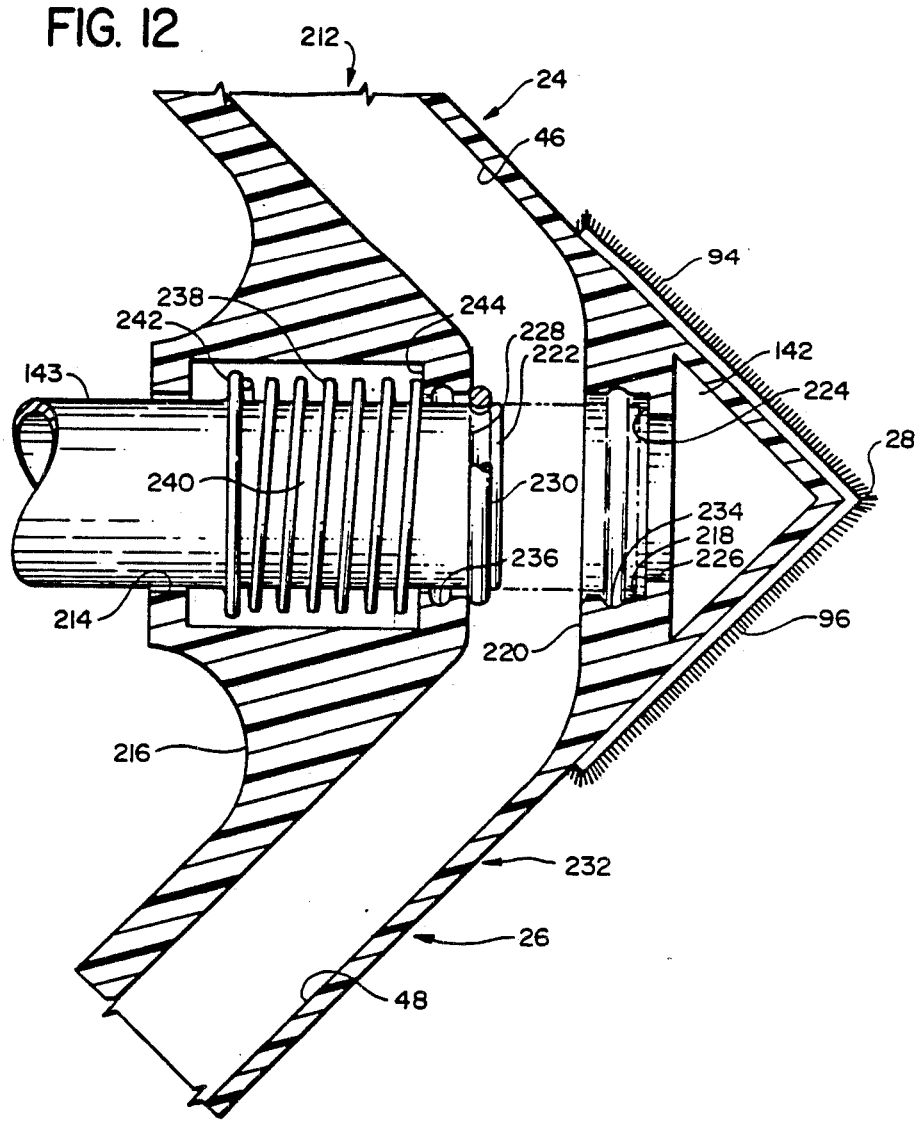
FIG. 12 is a view, similar to FIGS. 1, 8, and 11, of a fourth form of vacuum cleaner attachment employing the principles of the present invention.

Referring back to the drawing, FIG. 12 depicts yet another vacuum cleaner attachment 212 embodying the principles of the present invention. That attachment has all the capabilities of the vacuum cleaner attachment 170 illustrated in FIGS. 9–11. It differs from the latter primarily by the mechanism utilized to: (1) lock vacuum fitting 143 in a forward position to confine the vacuum to the chamber 142 in the nose 28 of the attachment, (2) lock the vacuum fitting in a retracted position so that the vacuum can also be distributed over the two wings 24 and 26 of the attachment, or (3) leave the fitting free to move between operator-determined positions which allow the vacuum to be concentrated in the nose of the attachment during the forward stroke or halting of the attachment and to be distributed over the wings of the attachment during the return stroke.

The vacuum fitting 143 of attachment 212 is slidably mounted in a longitudinally extending, central aperture 214 through vacuum fitting support 216.

In its extreme forward position, shown in dotted lines in FIG. 12, the fitting is located in a matching recess 218 in a partition 220. That partition isolates the vacuum chamber 142 in the nose 28 of attachment 212 from the vacuum chambers 46 and 48 in the wings 24 and 26 of the attachment.

In the dotted line position, the forward end 222 of fitting 143 butts against an annular ledge 224 in partition 220.

Communicating with the recess 218 just described is an aligned orifice 226 which cooperates with recess 218 to provide fluid communication between vacuum chamber 142 and fitting 143, either directly when the fitting is in its forwardmost position, or indirectly through the vacuum chambers 46 and 48 in the wings of the attachment when the fitting is in the operator-controlled mode of operation shown in FIG. 12 or locked in its rearwardmost position discussed below.

At the forwardmost end 222 of fitting 143 is a circumferential groove 228 in which a parted wire, compression ring 230 is fitted. Vacuum fitting 143 can be slid forward in support 216 with respect to the housing 232 of attachment 212 to snap ring 230 into an annular groove 234 formed in the recess 218 in partition 220 and lock or latch fitting 143 in the forward, dotted line position. In that position, the vacuum is concentrated in, and confined to, the vacuum chamber 142 in the nose 28 of the attachment.

Alternatively, vacuum fitting 143 can be displaced toward the rear of attachment housing 232 to snap ring 230 into a second, cooperating annular groove 236 formed in the central aperture or channel 214 through vacuum fitting support 216. This locks fitting 143 to housing 232 in a retracted position in which the vacuum is distributed over the chamber 142 and the two vacuum chambers 46 and 48 in the wings 24 and 26 of attachment 212, irrespective of whether the attachment is being pulled toward, or pushed away from, the operator.

In a third mode of operation, vacuum fitting 143 moves forwardly in support 216 to just short of the position in which ring 230 snaps into groove 234 when attachment 212 is pushed away from the user by fitting 143. This concentrates the vacuum in the vacuum chamber 142 in the nose 28 of the attachment.

As the attachment is instead pulled toward the vacuum cleaner operator, vacuum fitting 143 moves to the retracted position shown in FIG. 12; and the vacuum is consequently apportioned between vacuum chamber 142 and the two vacuum chambers 46 and 48 in the wings 24 and 26 of the attachment.

Fitting 143 is biased to the retracted position just described by a compression coil spring 238. That spring surrounds the forward part 240 of the fitting and is trapped between an integral, annular flange 242 at that end of the fitting and an annular ledge 244 in vacuum fitting support central passage 214.

From the foregoing, it will be apparent to the reader that vacuum attachment 212 has the same three modes of operation as attachment 170; viz., (1) concentration of the vacuum in the vacuum chamber 142 in the nose 28 of the attachment irrespective of the direction of movement of the attachment when ring 230 is snapped into groove 234, (2) apportionment of the vacuum between: (a) vacuum chamber 142 and (b) vacuum chambers 46 and 48 when fitting 143 is retracted and ring 230 snapped into groove 236, and (3) operator-influenced distribution of the vacuum in which the vacuum is concentrated in vacuum chamber 142 when the attachment is pushed forward by fitting 143 and distribution of the vacuum between that chamber and vacuum chambers 46 and 48 is effected when the attachment is pulled toward the operator by the fitting.

Any of several techniques may be employed to latch vacuum fitting 143 in its extreme forward and extreme retracted positions and to unlatch it from those positions. For example, the user's foot may be placed on the body 232 of the attachment to immobilize it and the fitting 143 then latched or unlatched by pushing it forward or by pulling on it, whichever is appropriate.

Alternatively, attachment 212 may be pushed into any stable object or structure such as a piece of furniture or a wall and the attachment vacuum fitting 143 then pushed away from the operator to unlatch the vacuum fitting from its extreme rearward position or to latch it into its extreme forward position. Conversely, the attachment may simply be pulled by fitting 143 against a piece of furniture to unlatch the fitting from its forward position or to latch it into its rearward position.

Finally, the user may simply employ one hand to hold housing 232 while using the other to push or pull on, and thereby latch or unlatch, vacuum fitting 143.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description; and all changes which come within the meaning and range of equivalency of the claims are therefore intended to be embraced herein.

What I claim is:

1. A vacuum cleaner attachement which is particularly adapted to reach into corners and crevices and to reach along walls, said attachment comprising: a V-shaped housing having a pair of independent, converging legs which meet and form a sharp nose at the forward end of the attachment, said legs each having inner, outer, and rear walls of substantially the same height and a top wall which cooperates with said inner, outer, and rear walls to form an elongated, open bottom vacuum chamber with an inverted U cross-section; a tubular vacuum fitting in communication at its forward end with the vacuum chambers in the first and second legs of said housing, said vacuum fitting having a component which is vertically rotatable relative to said housing about a transverse horizontal axis which is so spaced toward the front of the V-shaped housing from the rear of said housing that a downward force which will promote its cleaning efficiency can be exerted on said attachment; and a support for said vacuum fitting, said support being fixed to the inner walls of said legs and being fixed to said attachment only at the nose thereof, said support extending rearwardly from said nose between, but independently of, the converging legs of the V-shaped housing.

2. A vacuum cleaner attachment as defined in claim 1 wherein said vacuum fitting support includes means mounting said vacuum fitting for rotary movement about the longitudinal centerline of said attachment.

3. A vacuum cleaner attachment as defined in claim 2 wherein said vacuum fitting is comprised of two components, the first of said components being rotatable about said longitudinal centerline as aforesaid and the attachment further including means fixing said second component to said first component for vertical pivotal movement about the axis extending transversely of said attachemnt.

4. A vacuum cleaner attachment as defined in claim 1 which includes vertically depending brushes fixed to the outer walls of the legs of said housing at the nose of the housing.

5. A vacuum cleaner attachment as defined in claim 1 wherein the rear portion of said vacuum fitting is inclined upwardly relative to the forward portion of the fitting to facilitate the manipulation of said attachment and the exertion of pressure on the forward end of the attachement.

6. A vacuum cleaner attachment as defined in claim 1 wherein the first and second legs of the V-shaped housing meet in a right angle.

7. A vacuum cleaner attachment as defined in claim 1 which includes a cleaning brush extending longitudinally along and housed in each of said vacuum chambers, said burshes having bristles which are adapted to come into contact with and dislodge foreign substances from a surface being cleaned.

8. A vaccuum cleaner attachment as defined in claim 7 which includes means for mounting the brushes in the vacuum chambers in the legs of the V-shaped housing for rotation about axes extending in the same direction as the longitudinal axes of said legs, said brushes protruding below the lower sides of said legs whereby, as said attachment is moved forward and backward, said brushes will rotate in a manner that will provide a scrubbing action to dislodge foreign substances from the surfaces over which the attachment is moved.

9. A vacuum cleaner attachment which is particularly adapted to reach into corners and crevices and to reach along walls, said attachment comprising: a V-shaped housing having a pair of legs which meet and form a sharp nose at the forward end of the attachment, said legs each having walls which cooperated to form an elongated, open bottom vacuum chamber; a transverse partition spanning said housing at the nose of said housing and cooperating with the vacuum chamber defining walls of said legs to define a third vacuum chamber with an open lower side at the nose of the attachment; a tubular vacuum fitting in communication at its forward end and at the nose of said V-shaped housing with the vacuum chambers in said legs; and a support for said vacuum fitting, said support being fixed to said legs at the nose of said attachment and defining a vacuum plenum which provides fluid communication between said vacuum fitting and the vacuum chambers in the legs of said housing, said vacuum fitting being slidable in the vacuum fitting support into engagement with said partition and there being an opening through said partition in alignment with the forward end of said vacuum fitting whereby: (1) when said vacuum fitting is displaced toward the nose of the V-shaped housing and into engagement with said partition, said third chamber in the nose of the V-shaped housing is adapted to be connected through said vacuum fitting to a vacuum source, and (2) when said vacuum fitting is retracted from said partition, the vacuum chambers in the legs of said housing are also adapted to be connected to said vacuum source through said vacuum fitting.

10. A vacuum cleaner attachment as defined in claim 9 which has spring means for biasing said vacuum fitting away from said partition, whereby the chambers in the legs of the V-shaped housing are adapted to be connected to the vacuum source absent the deliberate application of a force which is effective to displace said vacuum fitting toward said partition.

11. A vacuum cleaner attachment as defined in claim 9 wherein said vacuum fitting support has front and rear walls in which said tubular vacuum fitting is slidably received, there being means at the forward end of said fitting which is adapted to keep said fitting from being withdrawn from said support.

12. A vacuum cleaner attachment as defined in claim 9 wherein said vacuum fitting support includes means mounting said vacuum fitting for rotary movement about the longitudinal centerline of said attachment.

13. A vacuum cleaner attachment as defined in claim 12 wherein said vacuum fitting is comprised of two components, the first of said components being rotatable about said longitudinal centerline as aforesaid and the attachment further including means fixing said second component to said first component for vertical pivotal movement about an axis extending transversely of said attachment.

14. A vacuum cleaner attachment as defined in claim 9 which includes vertically depending brushes fixed to the outer walls of the legs of said housing at the nose of the housing.

15. A vacuum cleaner attachment as defined in claim 9 which includes a cleaning brush extending longitudinally along and housed in each of said legs and means mounting the brushes in the legs for rotation about axes extending in the same direction as the longitudinal axes of said legs, said brushes protruding below the lower sides of said legs whereby, as said attachment is moved forward and backward, said brushes will rotate in a manner that will provide a scrubbing action to dislodge foreign substances from the surfaces over which the attachment is moved.

16. A vacuum cleaner attachment as defined in claim 9 wherein the first and second legs of the V-shaped housing meet in a right angle.

17. A vacuum cleaner attachment which is particularly adapted to reach into corners and crevices and to reach along walls, said attachment comprising: a V-shaped housing having a pair of legs which meet and form a sharp nose at the forward end of the attachment, said legs each having walls which cooperate to form an elongated, open bottom vacuum chamber; a transverse partition spanning said housing at the nose of said housing and cooperating with the vacuum chamber defining walls of said legs to define a third vacuum chamber with an open lower side at the nose of the attachment; a tubular vacuum fitting in communication at its forward end and at the nose of said V-shaped housing with the vacuum chambers in said legs; a support for said vacuum fitting, said support being fixed to said legs at the nose of said attachment and defining a vacuum plenum which provides fluid communication between said vacuum fitting and the vacuum chambers in the legs of said housing, said vacuum fitting being slidable in the vacuum fitting support into engagement with said partition and there being an opening through said partition in alignment with the forward end of said vacuum fitting whereby: (1) when said vacuum fitting is displaced toward the nose of the V-shaped housing and into engagement with said partition, said third chamber in the nose of the V-shaped housing is adapted to be connected through said vacuum fitting to a vacuum source, and (2) when said vacuum fitting is retracted from said partition, the vacuum chambers in the legs of said housing are also adapted to be connected to said vacuum source through said vacuum fitting; and control means that is effective to: (1) lock said vacuum fitting against said partition and thereby connect only said third chamber in the nose of the attachment to the vacuum source irrespective of the direction of movement of the attachment, (2) lock said vacuum fitting in a retracted position relative to said partition and thereby connect said third chamber and the chambers in the legs of the V-shaped housing to said vacuum source irrespective of the direction of movement of the attachment, and (3) allow movement of said fitting relative to said partition whereby said third vacuum chamber will be connected to the vacuum source when said attachment is displaced in a forward direction and said third chamber and said vacuum chambers in the legs of the V-shaped housing will be connected to said vacuum source when said attachment is displaced in a rearward direction.

18. A vacuum cleaner attachment as defined in claim 17 wherein said control means includes an operator which is accessible from the top side of said V-shaped housing and means for rotatably supporting said operator from said housing.

19. A vacuum cleaner attachment as defined in claim 18 wherein said control means further includes an external groove in said fitting toward the forward end thereof and a connection means for translating rotary movement of said operator into sliding movement of vacuum fitting in its support relative to said partition, said connection means being engaged in said operator and in said groove and being trapped between said opeator and said vacuum fitting.

20. A vacuum cleaner attachment as defined in claim 17 wherein said control means comprises means incorporated in said vacuum fitting which cooperates with: means in (a) said partition and in (b) said vacuum fitting support to respectively lock said vacuum fitting against said partition and in a retracted position relative to said partition.

21. A vacuum cleaner attachment as defined in claim 17 wherein there is a longitudinallly extending, centrally located opening through said vacuum fitting support for said fitting, wherein the means in said partition and in said vacuum fitting support respectively comprise circumferential grooves in said partition and in said support and wherein the cooperating means incorporated in said vacuum fitting comprises a ring surrounding and fixed to said fitting and dimensioned to fit into one or the other of said circumferential grooves to respectively latch said fitting to said partition and to said vacuum fitting support.

* * * * *

UNITED STATES PATENT AND TRADEMARK OFFICE

CERTIFICATE OF CORRECTION

PATENT NO. : 4,653,137

DATED : March 31, 1987

INVENTOR(S) : Eugene T. Fleischhauer

It is certified that error appears in the above—identified patent and that said Letters Patent is hereby corrected as shown below:

In the Claims:

Col. 14, line 56, "17" has been changed to --20--.

Signed and Sealed this

Seventeenth Day of October, 1989

*Attest:*

*Attesting Officer*

DONALD J. QUIGG

*Commissioner of Patents and Trademarks*